US006599349B1

(12) United States Patent
Scharkowski

(10) Patent No.: US 6,599,349 B1
(45) Date of Patent: Jul. 29, 2003

(54) PRECIPITATING TUBE BUNDLE FOR WET ELECTROFILTERS

(75) Inventor: Jürgen Scharkowski, Mogendorf (DE)

(73) Assignee: Steuler-Industriewerke GmbH (DE)

( * ) Notice: Subject to any disclaimer, the term of this patent is extended or adjusted under 35 U.S.C. 154(b) by 0 days.

(21) Appl. No.: 09/744,343

(22) PCT Filed: Jul. 22, 1999

(86) PCT No.: PCT/EP99/05248

§ 371 (c)(1),
(2), (4) Date: Mar. 22, 2001

(87) PCT Pub. No.: WO00/04996

PCT Pub. Date: Feb. 3, 2000

(30) Foreign Application Priority Data

Jul. 23, 1998 (DE) ..... 198 33 226

(51) Int. Cl.[7] ..... B03C 3/49

(52) U.S. Cl. ..... 96/49; 55/360; 55/DIG. 38; 95/59; 96/83; 96/88; 96/84; 96/100

(58) Field of Search ..... 96/45, 49, 83–85, 96/88, 92, 98, 100; 55/DIG. 38, 360; 95/59

(56) References Cited

U.S. PATENT DOCUMENTS

| | | | | | |
|---|---|---|---|---|---|
| 1,185,135 | A | * | 5/1916 | Seaman | 55/DIG. 38 |
| 1,393,712 | A | * | 10/1921 | Steere et al. | 55/DIG. 38 |
| 1,908,897 | A | * | 5/1933 | Heinrich | 55/DIG. 38 |
| 1,997,729 | A | * | 4/1935 | Herber | 55/DIG. 38 |
| 2,631,684 | A | | 3/1953 | Schmidt | 96/45 |
| 2,631,685 | A | * | 3/1953 | Hardy | 96/45 |
| 2,668,599 | A | * | 2/1954 | Whittet | 96/45 |
| 3,248,857 | A | * | 5/1966 | Weindel et al. | 96/49 |
| 3,765,154 | A | * | 10/1973 | Hardt et al. | 55/DIG. 38 |
| 3,793,802 | A | * | 2/1974 | Hardt | 55/DIG. 38 |
| 4,077,785 | A | * | 3/1978 | Hartshorn | 55/DIG. 38 |
| 4,177,047 | A | * | 12/1979 | Goland | 55/DIG. 38 |
| 4,202,675 | A | * | 5/1980 | Honacker | 96/49 |
| 4,441,897 | A | | 4/1984 | Young et al. | 96/36 |
| 5,626,652 | A | * | 5/1997 | Kohl et al. | 96/45 |

FOREIGN PATENT DOCUMENTS

| | | |
|---|---|---|
| DE | 2001092 | 10/1970 |
| DE | 3900553 C1 | 12/1989 |
| DE | 4102732 A1 | 8/1992 |
| GB | 882282 | 2/1960 |

* cited by examiner

*Primary Examiner*—Richard L. Chiesa
(74) *Attorney, Agent, or Firm*—Ohlandt, Greeley, Ruggiero & Perle, LLP; George W. Rauchfuss, Jr.

(57) ABSTRACT

A precipitation tube bundle for wet electrostatic filters is provided. The precipitation tube bundle consists of a plurality of single-piece precipitation tubes which are held at a distance from each other by an upper support collar, a central guide ring and a lower guide ring. The application is advantageous in that the tube bundle can be produced simply and economically, individual tubes can be replaced and when an electrical breakdown occurs in one of the precipitation tubes, the adjacent tubes are not damaged.

15 Claims, 3 Drawing Sheets

PRECIPITATING TUBE BUNDLE FOR WET ELECTROFILTERS

Figure 1:
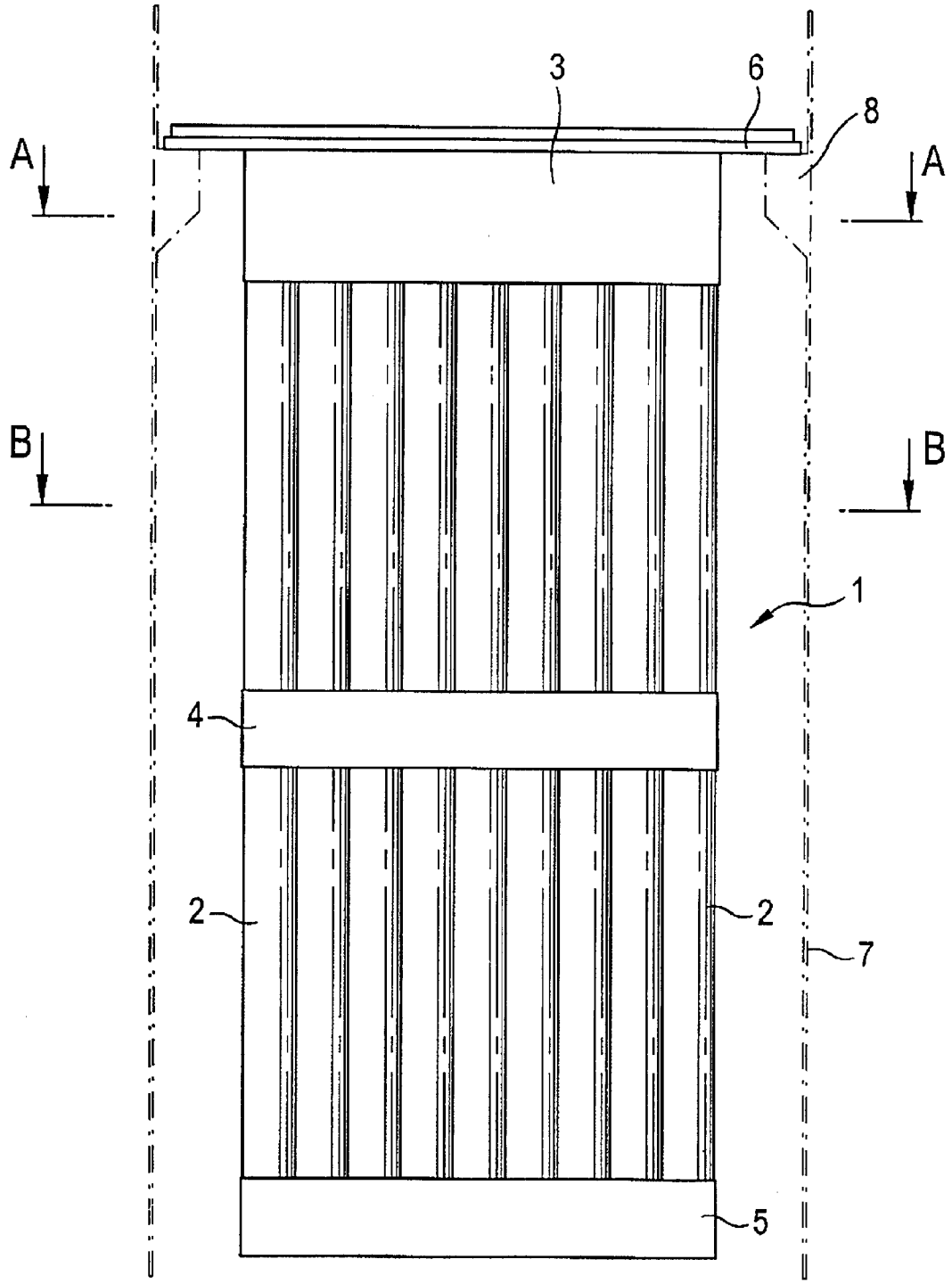

The invention relates to a precipitation tube bundle for wet electrostatic filters, in particular for the precipitation of sulfur oxides and dust from exhaust gases. Filters of this kind consist of a bundle of plastic tubes which are connected to each other at their walls. In the center of each tube there is an electrode. During operation of the filter, the inner walls of the tubes are wetted with a flowing, electrically conductive washing fluid, and between the electrode and the wall of the tube a strong electrical field is generated. This electrical field causes an ionization of the exhaust gases so that they are electrically charged and migrate to the walls of the tubes thereby following the lines of electric flux. At these walls the charged exhaust gas particles are taken up by the washing fluid and transported to the outside via the ends of the tubes. In order to avoid electrical breakdowns, the tubes are grounded.

DE-A1-41 02 732 discloses precipitation tube bundles in which the individual tubes are bonded to each other on their external walls. It is a disadvantage of these precipitation tube bundles that individual precipitation tubes cannot be replaced without being damaged and that the connection of the individual tubes requires much work and material.

In contrast thereto, it is an object of the present invention to provide a precipitation tube bundle for wet electrostatic filters in which the individual tubes can be held replaceably and in a low-stress and very accurate-to-dimension manner.

This object is achieved with the features of the claims.

In achieving this object, the invention starts out from the basic idea of holding single-piece tubes in a form-fit connection by means of an upper support collar and a lower guide ring and, if necessary, a central guide ring. By means of the support collar the bundle of tubes can be suspended in a housing. The lower guide ring serves for spacing the tubes apart and for connecting the tube grounding to the outside. The center guide ring serves for spacing the tubes apart if the bundle of tubes is relatively long.

The invention has the following advantages.

By combining stable, low-stress and very accurate-to-dimension guide and support rings with the precipitation tubes, bundles of tubes having a continuously smooth wall can be produced, wherein the distance between the tubes is reduced to a minimum. Bundles of tubes of different materials can be produced, for example, the supporting construction can be made of a material different from that of the precipitation tubes. The precipitation tube bundles have tube walls being separated from each other so that, for example, in case of voltage flashovers only the relevant tube is damaged. If they are damaged, the precipitation tubes can easily be replaced. Different kinds of grounding can easily be inserted in the precipitation tube bundles. The grounding can be prefabricated and easily be replaced or repaired in case of damage. The precipitation tube bundles can be produced more easily and cost-efficiently. In contrast to bundles consisting of connected half-tube elements, in the present invention there are no splits and/or borderings.

In the following, the present invention will be explained in more detail in connection with the drawings, wherein the center electrode in the tubes has been omitted for reasons of simplification.

Figure 2:
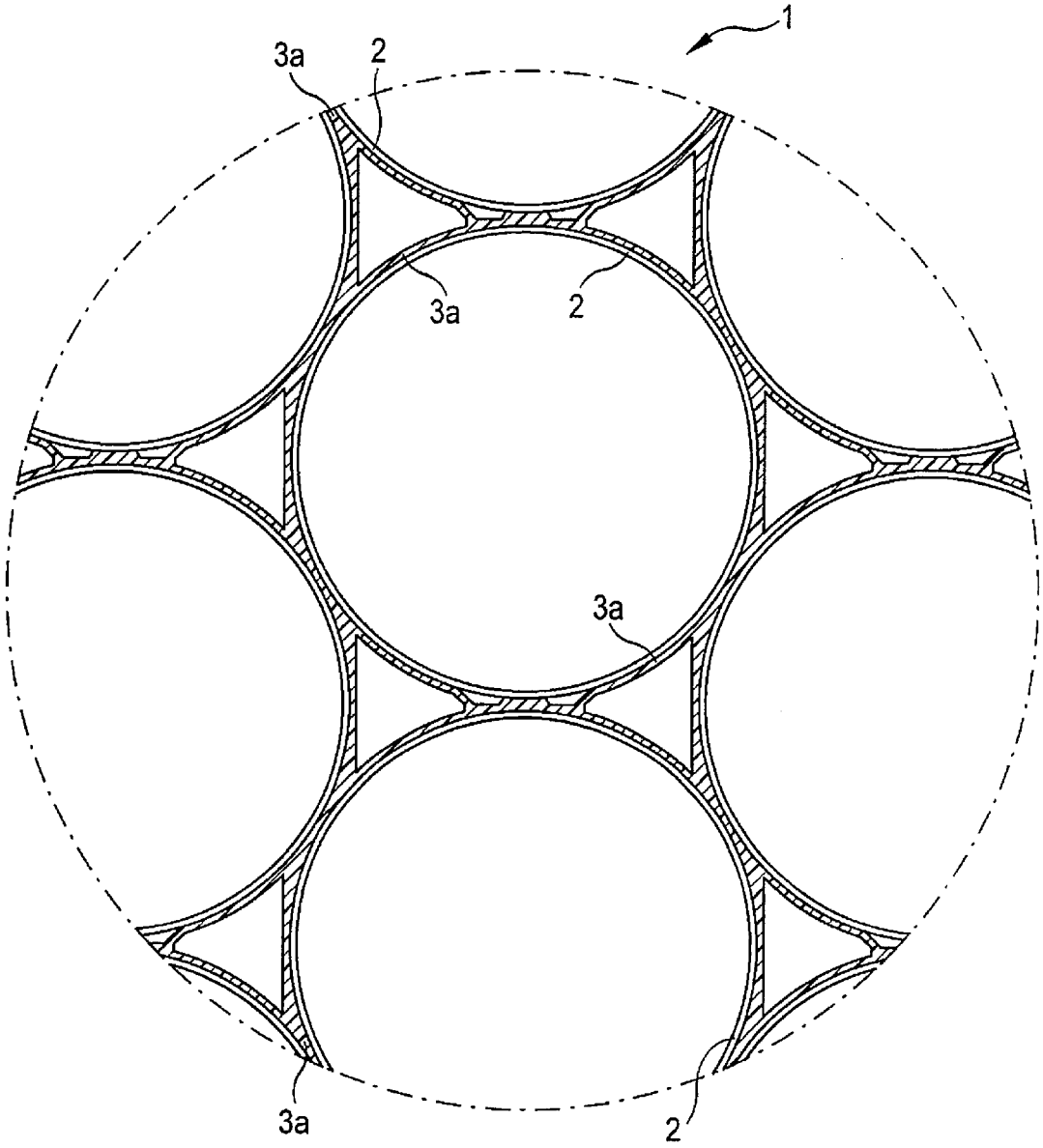
Figure 3:
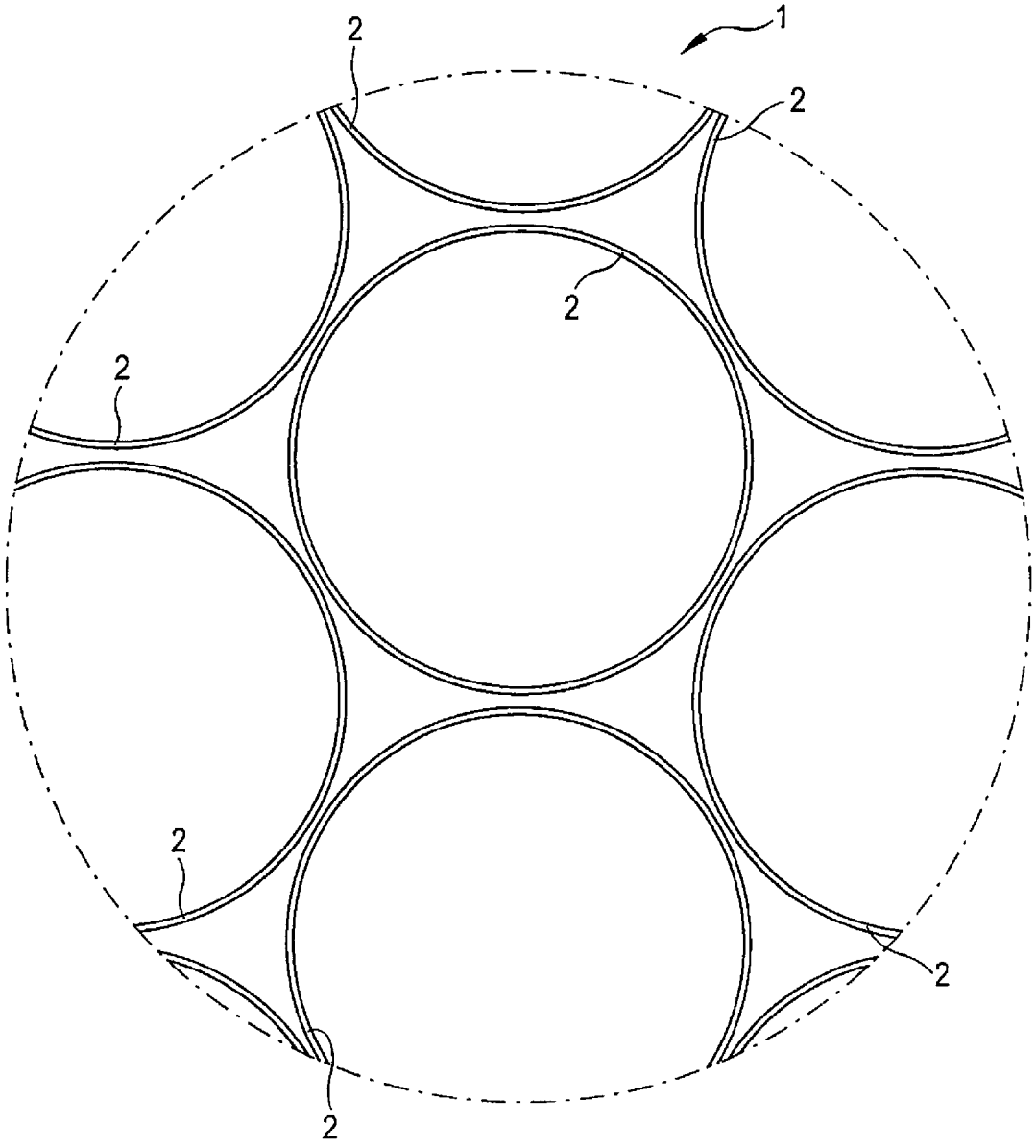

FIG. 1 shows a schematic side view of a precipitation tube bundle according to the invention in a housing, FIG. 2 shows a cross-section along the line A—A in FIG. 1, and FIG. 3 shows a cross-section along the line B—B in FIG. 1.

According to FIG. 1, a precipitation tube bundle 1 is suspended via a supporting flange 6 in a housing 7 on a projection 8. The smoke gases to be filtered penetrate the tubes 2 in the axial direction parallel to the plane in the drawings. The upper portions of the tubes 2 are held by an upper support collar 3 being rigidly connected with the support flange 6. The precipitation tube bundle 1 further comprises a center guide ring 4 which is provided for spacing the tubes 2 apart. At the lower end the precipitation tube bundle has a lower guide ring 5. The lower guide ring 5 serves for spacing the tubes 2 apart and for connecting the tube grounding to the outside. At the ends of the tubes the individual tubes 2 have spot welding seams or shear welding seams which can also penetrate the walls of the tubes in order to secure the tubes in the support collar and/or the guide rings against an axial displacement. The support collar 3 and the guide rings 4 and 5 hold the tubes in a form fit connection. The support flange 6 and the upper support collar 3 are preferably welded on. Each tube 2 of the precipitation tube bundle 1 has an upper grounding as an inner grounding and a lower grounding being welded into the surface of the tube and connected with the lower guide ring 5. The groundings of the individual tubes 2 are electrically connected with each other.

FIG. 2 shows a cross-section along the line A—A through the upper support collar 3 in FIG. 1. The individual tubes are held by semi-tube elements 3*a* being connected with one another. In this way an exact distance between the tubes can be guaranteed; thus, damage of adjacent tubes in case of electrical breakdowns is prevented and individual tubes 2 can easily be replaced. The semi-tube elements 3*a* are preferably produced of polypropylene in an injection molding process. The precipitation tubes 2 are produced in an extrusion process preferably of polypropylene or polyvinyl chloride or a conductive and/or hardly inflammable thermoplastic material, wherein the inner wall of the tube is preferably sand blasted in order to roughen the surface so that it can more easily be wetted.

FIG. 3 shows a cross-section along the line B—B in FIG. 1. It can be seen that the tubes 2 are arranged in areas outside the upper support collar and the center and lower guide rings in a non-contacting manner. Thus, possibly occurring stresses can be compensated and there is a free space for the replacement of, for example, damaged tubes 2. Preferably, the upper support collar 3 has a length of 900 mm in the axial direction, and the center and lower guide rings 4, 5 each have a length of 300 mm. The inner grounding of each tube preferably consists of an injection-molded ring made of polypropylene and comprising four graphite inserts and a graphite sheet cover. The lower grounding of each tube preferably consists of a carbon twine or flexible carbon tube.

The embodiment of the invention as shown in the drawings consists of single-piece round tubes having a circular cross-section. The precipitation tube bundle can, however, also consist of single-piece honeycomb tubes having a hexagonal cross-section.

What is claimed is:

1. A precipitation tube bundle (1) for wet electrostatic filters comprising (a) a plurality of single-piece precipitation tubes (2), (b) an upper support collar (3) for the precipitation tubes (2), (c) an insert for grounding each of the tubes, said insert comprising an upper grounding as an inner grounding and a lower grounding welded into a surface of the precipitation tube (2), wherein the groundings of the individual tubes (2) are electrically connected to each other, and wherein the inner grounding consists of an injection-molded polypropylene ring and comprising four granite inserts and a graphite sheet cover and the lower grounding consists of a carbon twine or flexible carbon tube, and (d) a lower guide ring (5) for spacing the precipitation tubes (2) apart and for connecting the tube grounding to the outside.

2. The precipitation tube bundle according to claim 1, characterized by at least one further guide ring (4) comprising a center guide ring being arranged between the upper support collar (3) and the lower guide ring (5) and serving for spacing the precipitation tubes (2) apart.

3. The precipitation tube bundle according to claim 1, characterized in that the precipitation tubes (2) are produced by extrusion.

4. The precipitation tube bundle according to claim 1, characterized in that on inner surfaces of the precipitation tubes (2) are sand blasted.

5. The precipitation tube bundle according to claim 1, characterized in that tube ends of the precipitation tubes (2) have spot welding seams or shear welding seams in order to axially secure the tubes.

6. The precipitation tube bundle according to claim 5, characterized in that the welding seams penetrate a wall of the tube.

7. The precipitation tube bundle according to claim 2, characterized in that the upper support collar (3), the center guide ring (4) and the lower guide ring (5) hold the precipitation tubes (2) in a form-fit connection.

8. The precipitation tube bundle according to claim 1, characterized in that the upper support collar (3) comprises a support ring (6) for supporting the precipitation tube bundle (1) in a housing (7).

9. The precipitation tube bundle according to claim 8, characterized in that the support ring (6) is welded to the support collar.

10. The precipitation tube bundle according to claim 1, characterized in that the upper support collar (3), the center guide ring (4) and the lower guide ring (5) each consist of semi-tube elements **(3*a*)** which are connected with each other.

11. The precipitation tube bundle according to claim 10, characterized in that the semi-tube elements **(3*a*)** are produced by injection molding.

12. The precipitation tube bundle according to claim 2, characterized in that the upper support collar (3), the center guide ring (4) and the lower guide ring (5) are made of polypropylene.

13. The precipitation tube bundle according to claim 1, characterized in that the precipitation tubes (2) are made of polypropylene or polyvinyl chloride or a conductive and/or hardly inflammable plastic material (thermoplastic material).

14. The precipitation tube bundle according to claim 2, characterized in that in an axial direction the upper support collar (3) is 900 mm long and the center guide ring (4) and the lower guide ring (5) are each 300 mm long.

15. The precipitation tube bundle according to claim 1, characterized in that the precipitation tubes (2) are round tubes or honeycomb tubes.

* * * * *

UNITED STATES PATENT AND TRADEMARK OFFICE

CERTIFICATE OF CORRECTION

PATENT NO. : 6,599,349 B1
DATED : July 29, 2003
INVENTOR(S) : Jurgen Scharkowski It is certified that error appears in the above-identified patent and that said Letters Patent is hereby corrected as shown below:

Column 3,
Line 3, "granite" should read -- graphite --.

Signed and Sealed this

Thirtieth Day of May, 2006

JON W. DUDAS
*Director of the United States Patent and Trademark Office*